United States Patent [19]

Katsuta

[11] Patent Number: 4,849,748

[45] Date of Patent: Jul. 18, 1989

[54] DISPLAY CONTROL APPARATUS WITH IMPROVED ATTRIBUTE FUNCTION

[75] Inventor: Hiroshi Katsuta, Tokyo, Japan

[73] Assignee: NEC Corporation, Tokyo, Japan

[21] Appl. No.: 89,793

[22] Filed: Aug. 27, 1987

[30] Foreign Application Priority Data

Aug. 27, 1986 [JP] Japan ..... 61-202234

[51] Int. Cl.[4] ..... G09G 1/16

[52] U.S. Cl. ..... 340/735

[58] Field of Search ..... 340/720, 721, 723, 732, 340/735, 789, 798, 799, 800, 801

[56] References Cited

U.S. PATENT DOCUMENTS

| | | | |
|---|---|---|---|
| 3,895,375 | 7/1975 | Williams | 340/801 |
| 4,375,638 | 3/1983 | O'Keefe et al. | 340/801 |
| 4,398,190 | 8/1983 | Long et al. | 340/723 |
| 4,504,828 | 3/1985 | Couper et al. | 340/799 |
| 4,555,700 | 11/1985 | Convis et al. | 340/721 |
| 4,595,996 | 6/1986 | Morley et al. | 340/800 |
| 4,613,856 | 9/1986 | Olin et al. | 340/735 |
| 4,646,077 | 2/1987 | Culley | 340/735 |
| 4,679,027 | 7/1987 | Higuchi | 340/735 |

*Primary Examiner*—Gerald L. Brigance
*Assistant Examiner*—Richard Hjerpe
*Attorney, Agent, or Firm*—Sughrue, Mion, Zinn, Macpeak & Seas

[57] ABSTRACT

A display control apparatus having an improved attribute function is disclosed. The control apparatus comprises a refresh memory having a plurality of storage addresses, each storage address storing a pattern code and an attribute code, an address circuit for selecting one of the storage addresses of the refresh memory and a video signal generator for generating a video signal in accordance with the pattern code and the attribute code, and features an attribute memory for storing a control code and a control circuit for making the attribute code from the refresh memory effective or ineffective in accordance with the content of the control code.

4 Claims, 4 Drawing Sheets

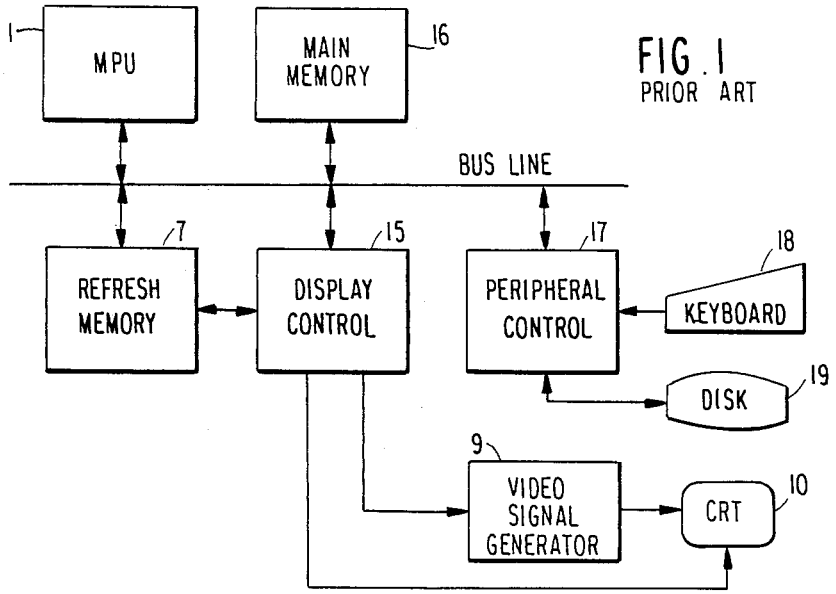
FIG. 1
PRIOR ART
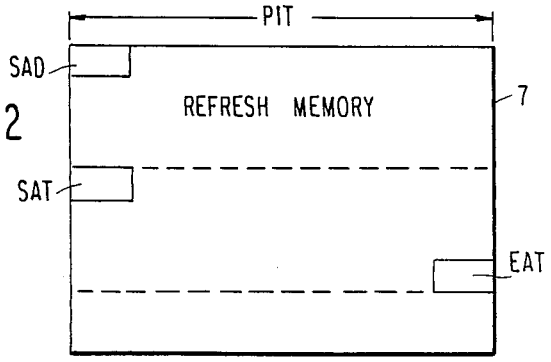
FIG. 2
FIG. 3
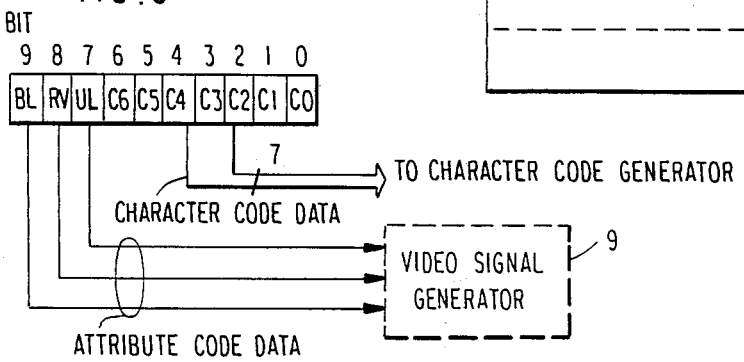
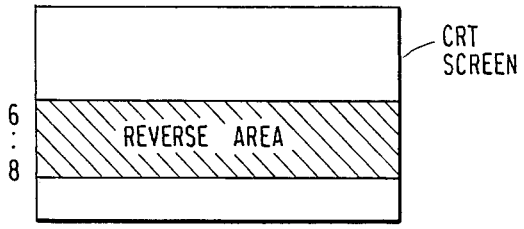
FIG. 4

DISPLAY CONTROL APPARATUS WITH IMPROVED ATTRIBUTE FUNCTION

BACKGROUND OF THE INVENTION

The present invention relates to an image display apparatus and more specifically to a display control apparatus for displaying patterns such as characters and figures on a raster scanning type CRT display.

It is one of the important functions of the display processing apparatus to be able to display on a cathode ray tube (CRT) screen information such as sentences (hereinafter referred to simply as text), figures and other images (simply referred to as graphics) stored in memory (e.g., a dynamic memory).

In recent years, demands for so-called new media related equipment such as personal computers, word processors and data base network services for private or home use have been growing remarkably. The importance of display processing as man-machine interface is therefore not only in the office automation (OA) equipment field but also in the home or consumer-use new-media-related equipment field. Also the mode of display has diversified. At the same time, the processes executed by the microprocessor which controls the system have become complex and large in volume. Under these circumstances, there are increasing demands for display equipment capable of controlling and processing display data efficiently.

With conventional display apparatuses of this kind, display is performed by first storing in a refresh memory information to be displayed such as text and graphics. Then the above information is successively read out in synchronism with the CRT scanning timing and converted into a video signal which is to be supplied to the CRT. For the text display in particular, the CRT screen is orderly divided into a large number of small sections, each of which is assigned with a character. The display position of the character is related to the address of the character code in the refresh memory. A series of character patterns obtained by reading the character code in successive addresses is used to display the text on the screen.

It is also known to display characters with underline or in a blinking manner. In order to perform the above modified display, pattern modifying information (hereinafter referred to as attribute information) specifying the shape, color and blink mode for each display datum is stored in the refresh memory with the character code of the display data. Upon display, the attribute information is read out in synchronism with the character code and is used in driving the corresponding attribute control hardware, and thereby modifying the display data.

In the above-mentioned conventional display technique, since the output signal of each bit of the attribute code stored in the refresh memory is directly supplied to the attribute control circuit, any change in the attribute specification for only a part of the display screen requires rewriting of not only the associated attribute code but also all the remaining attribute codes in the refresh memory.

The recent trend toward enhanced resolution in the display has entailed an increase in memory capacity, which in turn has resulted in a substantial increase in the amount of processing executed by the microprocessor in rewriting the refresh memory and in a drop in the display response speed and degraded operability. These drawbacks have already reached a point where they cannot be ignored.

On the other hand, there is also a trend toward increasing the number of characters being used, such as kanji (Chinese characters) and special characters used in scientific fields. Under these circumstances, sophistication of the attribute function itself is needed to make it possible to, e.g., underline at an arbitrary raster position and raster axis. This requires provision of special control circuits such as a dedicated register and a comparator, which is not desirable from an economical point of view.

SUMMARY OF THE INVENTION

It is an object of the present invention to provide a display control apparatus which can achieve the attribute function with ease and at a high speed without rewriting the contents of the refresh memory.

It is another object of the present invention to provide a display control apparatus which greatly improves operability of the attribute function with a reduced load of the microprocessor.

The display control apparatus according to the present invention is of the type having a image memory having a plurality of storage addresses, each of the storage addresses storing a pattern code representing a pattern to be displayed and an attribute code storing modification information for the pattern, an address circuit for selecting one of the storage addresses of the image memory and a video signal generator for generating a video signal in accordance with the pattern code and the attribute code of the selected storage address, and features a control memory for storing a control code and a control circuit coupled to the address circuit and the video signal generator for operatively making the attribute code of the selected storage address effective or ineffective in accordance with the content of the control code.

According to the present invention, the attribute codes stored in the image memory are selectively made effective and ineffective upon display in accordance with the control code. Therefore, execution or nonexecution display pattern modification can be made simply by controlling the content of the control memory, and therefore it is no longer necessary to rewrite all of the attribute codes in the image memory.

BRIEF DESCRIPTION OF THE DRAWINGS

FIG. 1 is a schematic block diagram showing a display apparatus according to the prior art;

FIG. 2 is a diagram showing a configuration of the refresh memory;

FIG. 3 is a diagram showing the format of character codes and attribute codes;

FIG. 4 is a diagram showing an example of a display;

DETAILED DESCRIPTION OF THE PRESENT INVENTION

Figure 5:
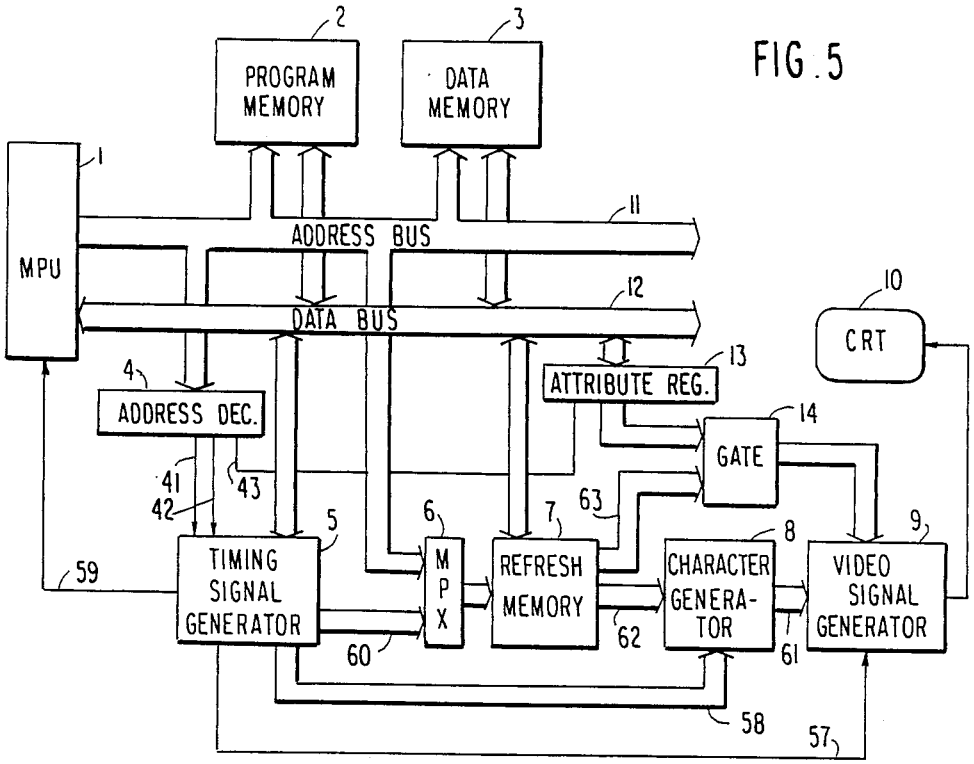
FIG. 5 is a schematic block diagram of a display control apparatus according to a first embodiment of the present invention.

Referring to FIG. 1, one example of the conventional display apparatus will be explained.

The display apparatus of FIG. 1 basically comprises a microprocessor (MPU) 1, a main memory 16, a refresh memory 7, a display control circuit 15 for controlling a video signal generator circuit 9 and a CRT 10, and a peripheral control circuit 17 coupled to a keyboard 18 and a disk unit 19 as an external memory.

The respective units 1, 16, 7, 15 and 17 are connected through a bus line (BUS Line) to each other.

The apparatus of FIG. 1 realizes a variety of processing functions by controlling the operation of the system as a whole by means of the microprocessor 1. The main memory 16 stores programs to be executed by the microprocessor 1 and processed data. Interfacing with the keyboard 18 and the disk equipment 19 storage device is performed through the peripheral control circuit 17. The display data stored in the refresh memory 7 is processed through the display control circuit 15 to provide a desired display on the CRT 10. The display control circuit 15 generates an address for the desired data contained in the refresh memory 7 in synchronism with internal display timing which is produced within the circuit. The display data read out from the memory 7 is converted from the parallel form to serial signals by the video signal generating circuit 9 and supplied to the CRT 10.

FIG. 2 shows an example of how data is stored in the refresh memory 7, in which SAD represents a display starting address; SAT, an attribute starting address; EAT, an attribute end address; and PIT, the address pitch. The data for each display section is structured, as shown in FIG. 3, of 7-bit character code data composed of 7 bits $C_0$–$C_6$ and a 3-bit attribute code composed of 3 bits UL, RV and BL.

The character code data ($C_0$–$C_6$) represent the character to be displayed and the attribute code data (UL, RV, BL) control the modification of the character defined by the character code data. More specifically, the bit UL controls whether the character to be displayed is underlined or not on the CRT 10, and upon a UL bit value of "1", the video signal generator 9 achieves the display of the character with an underline. The bit RV controls whether the character is reversed (i.e., displayed as a "negative" or "positive" image) or not, and a "1" value of this bit reverses the relation of the character and its background pattern to create a negative image through the generator 9. The attribute bit BL is used to determine whether the character is displayed in a blinking manner or not, and a value "1" makes the generator 9 display the character defined by the character code data ($C_0$–$C_6$) in the blinking manner through the generator 9.

For example, when the reverse attribute is to be added only to the characters at the 6th to 8th line on the CRT screen, as shown in FIG. 4, the microprocessor calculates the attribute setting start address SAT shown in FIG. 2 and the attribute setting end address EAT from the following formulas:

$$(SAT)=(SAD)+(6-1)\times(PIT)$$

$$(EAT)=(SAD)+8\times(PIT)-1$$

The microprocessor 1 then sets the reverse bit RV of all the attribute codes contained in the above address range at such a timing as will have no adverse effect on the display screen, i.e., during the short flyback period of the CRT timing. For the other areas, the microprocessor 1 resets the reverse bit. In this way, the attribute codes for the entire display screen are rewritten.

In the above-described conventional display control apparatus, since the output signal of each bit of the attribute code stored in the refresh memory is directly supplied to the attribute control circuit, any change in the attribute specification for only a part of the display screen requires rewriting of not only the associated attribute code but also all the remaining attribute codes in the refresh memory, after calculating the address to be changed.

Referring to FIG. 5, a display control apparatus according to a first embodiment of the invention will be described.

With the apparatus of FIG. 5, the display on the CRT 10 is accomplished by controlling the operation of the entire system via a microprocessor (MPU) 1. The program to be executed by the microprocessor 1 is stored in a program memory 2 and the data processed by the microprocessor 1 is stored in a data memory 3. The display data stored in the refresh memory 7 is manipulated through a multiplexer 6. Contained in the refresh memory 7 are character code data 62 and attribute code data 63 as display information.

The character code data 62 is applied to the character generator 8 while the attribute code data 63 is applied to a gate circuit 14. The character code data 62 and the attribute code data 63 are stored in the format shown in FIG. 3 in the refresh memory 7.

Attribute register 13 is a characterizing element of the invention as is the gate circuit 14. The attribute register 13 stores information which enables or disables the attribute code data 63, as explained hereafter. A timing generator 5 produces, in synchronism with the internal display timing generated within the circuit, an address 10 for the refresh memory 7, a raster address for the character generator 8, a display timing signal for the video signal generator 9, and a synch signal for the CRT 10. The character code data read out from the refresh memory 7 is supplied to the character generator 8 which produces a character pattern signal 61 according to the raster address 58. The character pattern signal 61 is sent to the video signal generator 9 together with the attribute code read from the refresh memory 7. The video signal generator 9 in turn sends a video signal together with the synch signal to the CRT 10.

Figure 6:
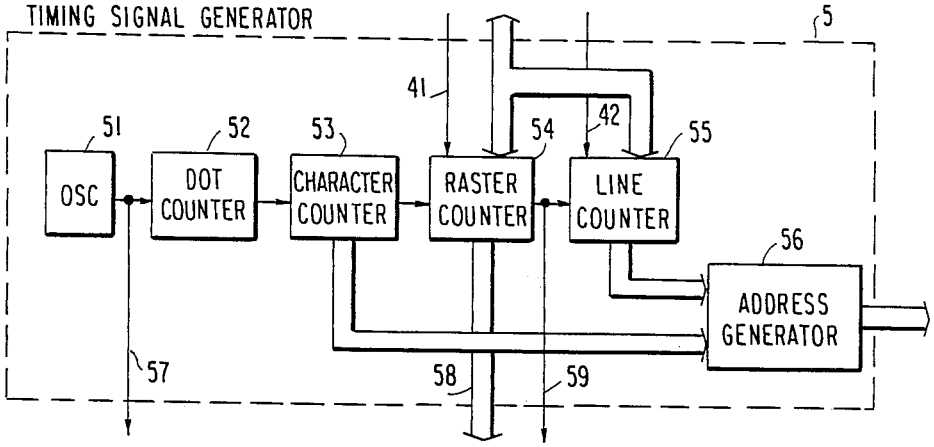
FIG. 6 is a schematic block diagram of the timing signal generator of FIG. 5.

FIG. 6 shows the detailed structure of the timing generator 5. An oscillator (OSC) 51 generates a dot clock 57 for sending the character patterns 61 serially to the CRT 10. A dot counter 52 counts the number of lateral dots in one character in synchronism with the dot clock 57. A character counter 53 counts the number of characters on each horizontal scanning line according to the carry of the dot counter 52. A raster counter 54 counts the number of vertical rasters for one character according to the carry of the character counter 53.

The raster counter 54 can also be selected by a strobe signal 41 from an address decoder 4 to be read or written by the microprocessor 1. The output of the carry of the raster counter 54 is supplied as an interrupt signal 59 to the microprocessor 1. The line counter 55 counts the number of lines of characters according to the carry of the raster counter 54 and is also selected by the strobe signal 42 to be read or written by the microprocessor 1. The address generating circuit 56 generates display addresses from the outputs of the character counter 53 and the line counter 55 and feed them to the refresh memory 7. The output of the raster counter 54 is supplied as the raster address 58 to the character generator 8.

Figure 7:
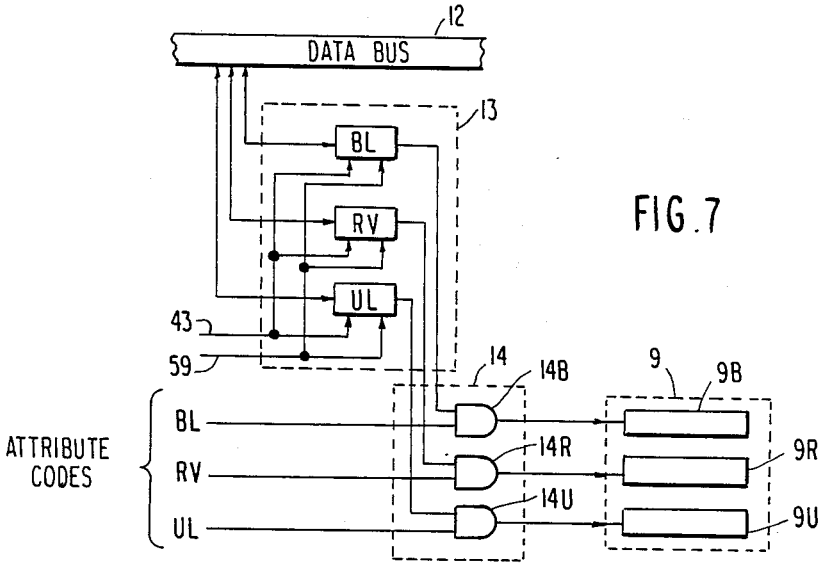
FIG. 7 is a schematic block diagram of the attribute register of the apparatus of FIG. 5.

FIG. 7 shows the detailed structure of the attribute register 13 and the gate circuit 14. The attribute register 13 includes registers BL, RV and UL which store execution information for blinking, reverse image and underlining, respectively. Their outputs change in synchronism with the occurrence of the interrupt signal 59. The attribute register 13 can be selected by the strobe signal 43 to be read or written by the microprocessor 1. The gate circuit 14 includes AND gates 14B, 14R and 14U. The AND gate 14B receives the output of the register BL and the blinking attribute code BL from the memory 7. An output of the AND gate 14B is fed to a blinking control circuit 9B of the video signal generator 9. The AND gate 14R receives the output of the register RV and the reverse image attribute code RV of the attribute code data 63. An output of the AND gate is fed to a reverse control circuit 9R of the generator 9. Similarly, the AND gate 14U receives the output of the register UL and the underline attribute code UL of the attribute code data 63. An output of the AND gate 14U is fed to an underline control circuit 9U of the generator 9. The blinking control circuit 9B, the reverse control circuit 9R and the underline control circuit 9U perform the display function with modifications to the blinking mode, the reverse image display and the underlining when the outputs of the AND gates 14B, 14R and 14U are "1", respectively.

The address decoder 4 of FIG. 5 produces strobe signals 41, 42, 43 based on the address signal on an address bus 11 when the microprocessor 1 reads and writes the contents of the raster counter 54, line counter 55 and attribute register 13 respectively. The raster counter 54, line counter 55 and attribute register 13 are each connected to the microprocessor 1 through the address bus 11 and data bus 12.

In the blanking period of the synch signal, the multiplexer 6 switches the address of the refresh memory 7 to the address bus 11 of the microprocessor 1 to enable the microprocessor 1 to rewrite the data in the refresh memory 7. In the period other than the blanking period of the synch signal, the display address from the timing generator 5 is connected to the address bus 11.

Assigned to the data memory 3 are display variables entered from a keyboard to be processed by the program. These include attribute specification information ATR specifying the contents of the attribute register 13; the attribute start line SAL representing the line position on the screen of the CRT 10 at which the attribute specification starts; and the attribute end line EAL indicating the line position at which the attribute specification is ended.

Figure 8:
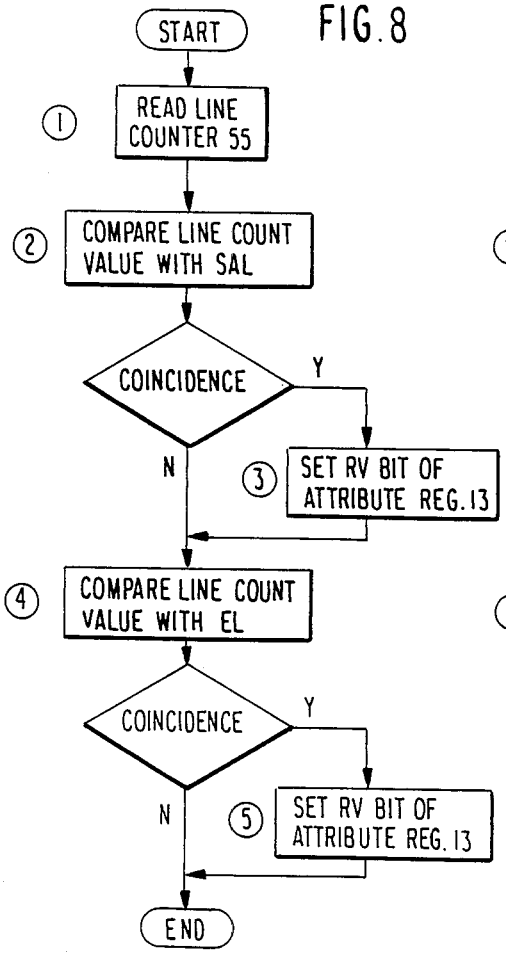
FIG. 8 is a flowchart of interrupt program processing in the apparatus of FIG. 5.

FIG. 8 is a flowchart of the interrupt program processing for the microprocessor 1 which is started for each line by the interrupt signal 59 from the raster counter 54. Referring to this flowchart, the processing for updating the reverse specification information RV of the attribute register 13 is explained below by way of example.

First, the contents of the line counter 55 are read out (step 1) and are compared with the attribute start line SAL (step 2). If they do not coincide, the line count value is compared with the attribute end line EAL (step 4). If the contents coincides with the attribute start line SAL, the RV bit of the attribute register 13 is set according to the contents of the attribute specification information ATR (step 3). After this, the line count value is compared with the end line EAL, and if the two values do not coincide, the interrupt program processing is terminated. On the other hand, if they coincide, the RV bit of the attribute register 13 is reset according to the contents of the attribute specification information ATR (step 5) and the microprocessor 1 terminates the interrupt program processing and returns to the main program.

Figure 9A:
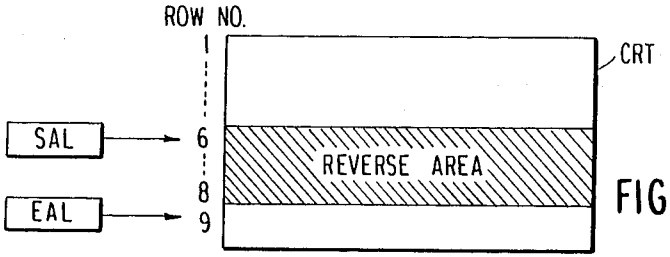
FIGS. 9A and 9B are diagrams showing examples of the display produced by the apparatus of FIG. 5.
Figure 9B:
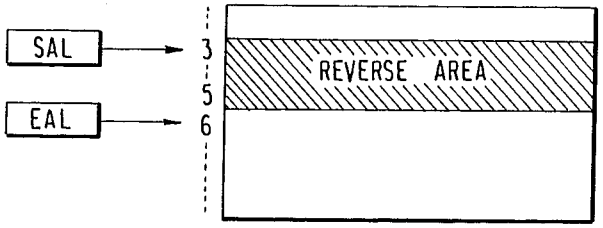

In the above series of processing steps, if the reverse image attribute is preset in the desired part or entire area of the attribute code data in the refresh memory 7, the addition of reverse attribute to, e.g., the sixth through eighth lines can be accomplished simply by setting the reverse bit RV of the attribute specification information ATR so as to be effective (ON) and by setting the attribute start line SAL to six and the attribute end line EAL to nine, as shown in FIG. 9A. When the reverse attribute indication is to be changed to the third through fifth lines, the attribute start line SAL and the attribute end line EAL need only be set to three and six respectively as shown in FIG. 9B. The above processing does not require a large number of data transfers, but requires the microprocessor 1 to perform only a simple comparison and transfer, and therefore the processing time is very short.

The display control apparatus of the second embodiment has the identical block diagram as the first embodiment shown in FIG. 5. The block configuration and its operation are the same as those of the first embodiment except for the data memory 3 and the timing generator 5, and thus a detailed explanation is omitted but for the latter two elements.

Figure 10:
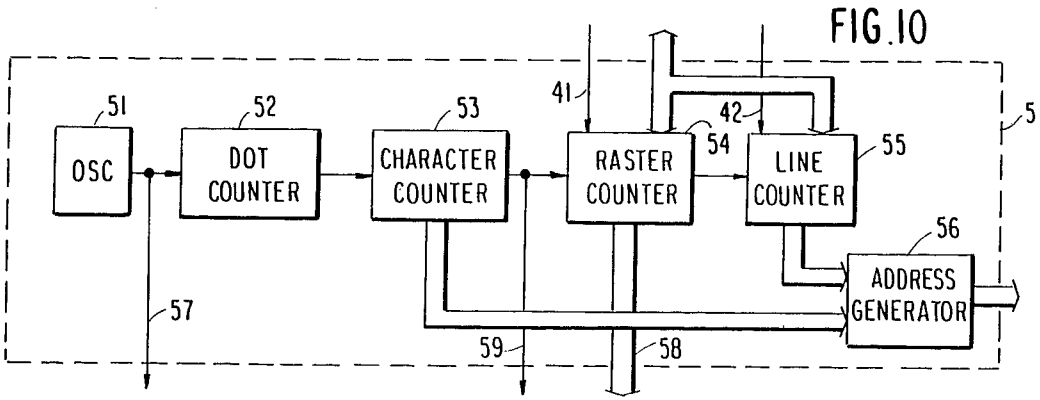
FIG. 10 is a schematic diagram of a major part of a display control apparatus according to a second embodiment of the present invention.

FIG. 10 shows the detailed block diagram of the timing generator circuit 5 according to the second embodiments. The block configuration and operation of this circuit are identical to those of the first embodiment except that the carry output of the character counter 53 is supplied as an interrupt signal 59 to the microprocessor 1.

Assigned to the data memory 3 are display variables entered from the keyboard to be processed by the program. These include attribute specification information ATR specifying the contents of the attribute register 13; attribute start raster SAR representing the raster position in one character at which the attribute specification starts; and attribute end raster EAR indicating the raster position at which the attribute specification ends.

Figure 11:
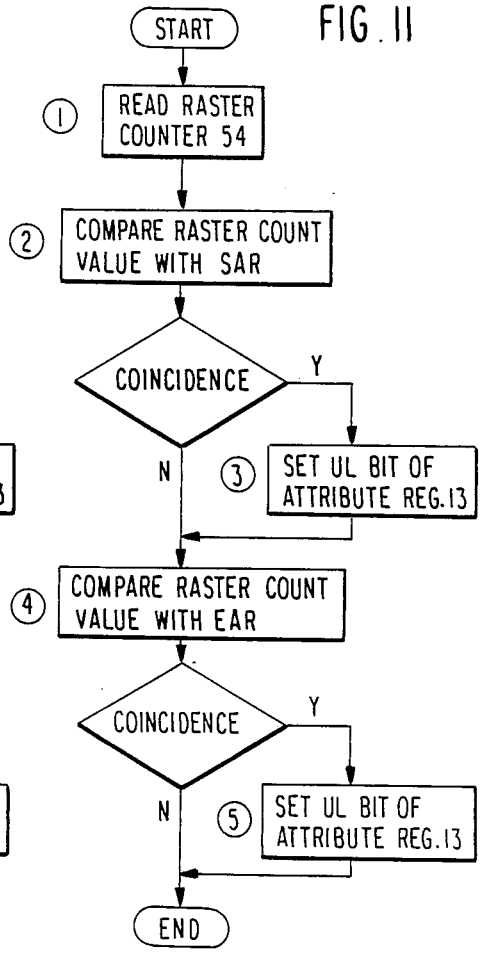
FIG. 11 is a flowchart of the interrupt program processing in the second embodiment.

FIG. 11 is a flowchart of the interrupt program processing for the microprocessor 1 which is started for each raster by the interrupt signal 59 from the character counter 53. Referring to this figure, the processing for updating the underline specification information UL of the attribute register 13 will be explained in the following.

First, the contents of the raster counter 54 are read out (step 1) and compared with the attribute start raster SAR (step 2). If they do not agree, the raster counter value is further compared with the attribute end raster EAR (step 4). If on the other hand to raster counter value agrees with the attribute start raster SAR, the UL bit of the attribute register 13 is set according to the contents of the attribute specification information ATR (step 3). After this, the raster counter value is compared with the attribute end raster EAR (step 4). If the contents of the raster counter 54 do not agree with the attribute end raster EAR, the microprocessor terminates the interrupt program and returns to the main program. If on the other hand the raster count value is identical with the attribute end raster EAR, the microprocessor resets the UL bit of the attribute register 13 according to the content of the attribute specification information ATR (step 5) and then returns to the main program.

Figure 12A:
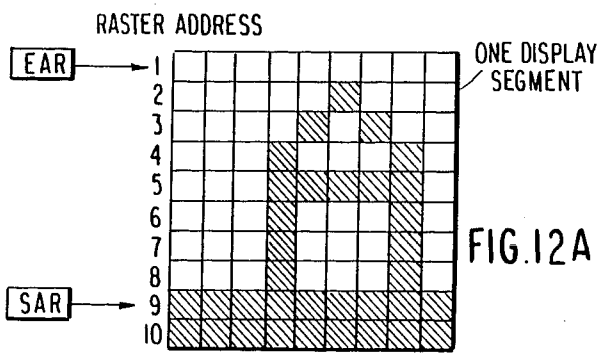
FIGS. 12A and 12B are diagrams of display produced according to the second embodiment.
Figure 12B:
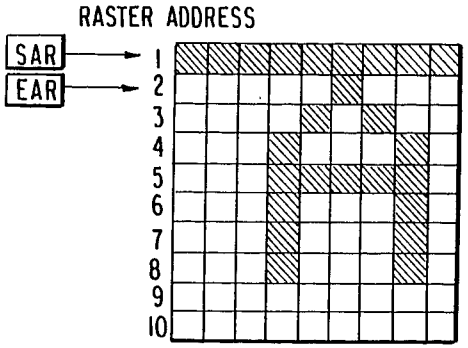

In the above-described processing steps, if the underline attribute is preset in the desired part or entire area of the attribute code data in the refresh memory 7, the addition of underlining to two rasters at the ninth and 10th raster of a line which is ten rasters high can be accomplished by setting the underline bit UL of the attribute specification information ATR to ON and the setting the attribute start raster SAR to nine and the attribute end raster EAR to one, as shown in FIG. 12A. Also, as shown in FIG. 12B, setting the attribute start raster SAR to one and the attribute end raster EAR to two produces an overline at the first raster. With this embodiment, the raster address control can easily be achieved with the minimum possible amount of hardware without having to add special hardware such a register or comparator for detecting the raster position as is required with the conventional apparatus.

As described in the foregoing, since the apparatus of the invention does not require rewriting of the display data in the refresh memory 7 to change the attributes, the burden of the microprocessor can be significantly reduced, which in turn improves operability and response time of the CRT display in the display control apparatus. Also, a sophisticated display can be realized by simple processing of the microprocessor without requiring dedicated hardware. Sharing the hardware in this way reduces the amount of hardware required, making it possible to achieve an inexpensive and flexible display control apparatus.

I claim:

1. A display control apparatus comprising:

an image memory having a plurality of storage addresses, each of said plurality of storage addresses storing a pattern code indicating a pattern to be displayed and an attribute code indicating modification of a pattern designated by said pattern code stored at the same storage address;

an address circuit for serially selecting said storage addresses of said image memory one by one;

a control memory for storing a control code assuming one of first and second states which is independent of the contents of attribute codes of said image memory;

means for designating a storage address of said image memory to be modified;

means responsive to said storage address designated by said designating means for setting said control code to said first state when said storage address selected by said address circuit coincides with said designated designated storage address, and to said second state when said storage address selected by said address circuit does not coincide with said storage address;

a control circuit receiving said attribute code, and said control code stored in said control memory, said control circuit generating an attribute execution signal only when said control code is in said first state; and a video signal generator coupled to said image memory and said control circuit for generating a first video signal representing a pattern corresponding to said pattern code without modification thereof when said control code is in said second state, and for generating a second video signal representing a modified pattern which corresponds to said pattern code and is modified by said attribute code when said control code is in said first state, wherein either one of said first and second video signals is generated from the same contents of said image memory according to said control code.

2. The display control apparatus according to claim 1, wherein said control circuit includes an AND gate receiving said attribute code and said control code.

3. The display control apparatus according to claim 1, wherein said designating means includes a control memory.

4. A display control apparatus comprising:

a first memory having a plurality of storage addresses, each of said plurality of storage addresses storing a pattern code indicating a pattern to be displayed and an attribute code indicating a modification of said pattern;

a second memory for storing a control code taking one of first and second states independent of said attribute code;

first means for consecutively selecting said storage addresses of said first memory for execution of modification according to said attribute code;

a third memory for storing address information indicating said storage address of said first memory for execution of modification according to said attribute code;

means for selectively setting said control code in said first state when said storage address selected by said first means coincides with said address information stored in said third memory, and in said second state otherwise;

second means for reading said control code stored in said second memory;

a control circuit coupled to said first and second means to receive said attribute code and said control code, said control circuit generating an execute attribute signal at an output terminal only when said control is in said first state;

a video signal generator coupled to said first means and said output terminal of said control circuit, for generating a first video signal indicating a pattern defined only by said pattern code when said execution attribute signal is not present and a second video signal indicating a modified pattern defined by both said pattern code and said attribute code when said execution attribute code is present.

* * * * *